US005992636A

United States Patent [19]

Mock et al.

[11] Patent Number: 5,992,636

[45] Date of Patent: Nov. 30, 1999

[54] PARTS SUPPLYING APPARATUS AND PARTS ARRAY

[75] Inventors: Elmar Mock, Biel, Switzerland; Yasuyuki Moriyama, Funabashi, Japan

[73] Assignee: Tetra Laval Holdings & Finance S.A., Pully, Switzerland

[21] Appl. No.: 09/219,464

[22] Filed: Dec. 23, 1998

Related U.S. Application Data

[62] Division of application No. 08/983,503, Mar. 31, 1998, Pat. No. 5,885,044.

[30] Foreign Application Priority Data

Jul. 21, 1995 [JP] Japan ..... 7-207819

[51] Int. Cl.[6] ..... B65D 69/00

[52] U.S. Cl. ..... 206/526; 53/397; 206/820

[58] Field of Search ..... 53/397, 448; 206/340, 206/343, 526, 820; 414/416; 493/87

[56] References Cited

U.S. PATENT DOCUMENTS

| | | | |
|---|---|---|---|
| 2,894,652 | 7/1959 | Glass . | |
| 3,302,854 | 2/1967 | Midgley et al. | 206/526 |
| 3,906,614 | 9/1975 | Rayburn . | |
| 3,967,787 | 7/1976 | Mulleman . | |
| 4,005,834 | 2/1977 | Landreau . | |
| 4,069,931 | 1/1978 | Saylors . | |
| 4,158,532 | 6/1979 | Kowalski . | |
| 4,386,043 | 5/1983 | Takeshima . | |
| 4,508,220 | 4/1985 | Pearson | 206/343 |
| 4,842,673 | 6/1989 | Kurihara . | |
| 5,176,300 | 1/1993 | Kishikawa et al. | 493/87 |
| 5,226,778 | 7/1993 | Sekitani . | |
| 5,299,902 | 4/1994 | Fujiwara et al. . | |
| 5,310,301 | 5/1994 | Aono . | |
| 5,348,238 | 9/1994 | Yamauchi et al. . | |
| 5,435,803 | 7/1995 | Owen et al. | 493/87 |
| 5,484,374 | 1/1996 | Bachner et al. | 493/87 |

*Primary Examiner*—Jim Foster

*Attorney, Agent, or Firm*—Burns, Doane, Swecker & Mathis, L.L.P.

[57] ABSTRACT

A parts supplying apparatus for supplying an array of resin molded part (10) includes an elongated guide member (80) having a longitudinally extending guide passage (81) through which the parts array is fed, and a rotatably driven winding device (43). The guide member has a guide surface (83) along which the parts array is guided and is also provided with at least one hole (85) through which the carrier (31, 33) is drawn to allow the carrier to be drawn away and separated from the molded parts. The carrier is adapted to be wound on the winding device for pulling the carrier and effecting movement of the parts array within the guide passage and for causing the carrier to be separated from the molded parts as the molded parts move past the hole in the guide member. A parts array utilized in conjunction with such an apparatus includes a plurality of molded parts and a carrier to which each of the molded parts are arranged in a row on the carrier. The molded parts are attached to the carrier in such a way that the molded parts are separable from the carrier when the carrier is pulled away from the molded parts. The carrier can be in the form of a pair of wires (31, 33) or a tape (131).

9 Claims, 4 Drawing Sheets

PARTS SUPPLYING APPARATUS AND PARTS ARRAY

This application is a divisional of application Ser. No. 08/983,503, filed Mar. 31, 1998 now U.S. Pat. No. 5,885,044.

FIELD OF THE INVENTION

The present invention relates to a parts supplying apparatus, a parts array used in such an apparatus, and a process for forming a parts array. More specifically, the present invention pertains to an apparatus for supplying resin molded parts such as pouring attachments that are to be used on containers, an array of resin molded parts such a pouring attachments, and a process for forming such an array.

BACKGROUND OF THE INVENTION

Liquid holding containers that are made of paper, plastic or the like are typically provided with a pouring attachment or pouring spout through which the liquid contents can be dispensed from the container. These pouring attachments are oftentimes molded from plastic material and subsequently attached to the container. Once attached, the pouring attachment can then be opened to pour the contents from the container.

An automatic attachment device is utilized to automatically attach the molded resin pouring attachment to the container. These automatic attachment devices are designed to continuously advance the containers along a conveying path with the pouring attachments being secured or attached one by one to the continuously moving containers.

A parts supplying apparatus is typically used to feed the pouring attachments to the automatic attachment device. The parts supplying apparatus is designed to align and continuously feed the pouring attachments one by one to the automatic attachment device. Conventional parts supplying apparatus are mainly of the vibrating type in which the parts such as the pouring attachments are aligned and fed one by one.

Vibrating parts feeders or supplying apparatus include a rail arranged in a spiral shape at a fixed sloping angle. Vibration is applied to the rail while the parts are supplied at one time to the center portion of the rail. The vibration causes the parts to vibrate and thus align in a row and gradually move down the sloping rail.

However, with the vibrating parts feeder described above, problems exist in that a substantially long rail must be used in order for the parts to align in a single row. Additionally, due to the complexity of the shape of the rail and the structure of the overall apparatus, it is difficult, if not impossible, to reduce the size of the apparatus and the costs are prohibitive.

Furthermore, in the case of containers for holding liquids contents for drinking, the pouring attachment to be attached to the container must be in a hygienic or sterile state. However, when utilizing a vibrating parts feeder such as that described above for feeding the pouring attachments for subsequent attachment to the container, it is possible for foreign objects to cling to the pouring attachments as the pouring attachments gradually move down the rail. These foreign objects on the pouring attachments can adversely affect the sterility of the containers when the pouring attachments fed by the vibrating parts feeder are subsequently attached to the containers.

In addition to the problems identified above, vibrating parts feeders of the type described above suffer from the disadvantage that although the feeders can align the parts to some extent, situations arise where the vibratory action is not entirely effective to produce a well formed row of parts. Also, problems have arisen in the context of using the feeders to feed parts having different shapes. In this regard, portions of the vibratory parts feeder may not be well suited to the particular shape of the parts being fed and so difficulties arise in properly aligning the parts in a row, Thus, it has been found necessary in some instances to perform tests and effect design alterations in the feeder to address such problems.

SUMMARY OF THE INVENTION

In light of the foregoing, a need exists for a parts supplying apparatus as well as a parts array that permits realization of cost reductions and size reductions of apparatus suitable for feeding parts.

A need also exists for a parts supplying apparatus and a parts array that is designed to achieve accurate orientation of the supplied parts.

It would also be desirable to provide a sterile and hygienic parts supplying apparatus and parts array.

According to one aspect of the present invention, a parts supplying apparatus for supplying parts attached to a carrier in the form of a parts array includes an elongated guide member having a longitudinally extending guide passage through which the parts array is fed with the parts being discharged from the guide member. The guide member possesses a guide surface along which the parts array is guided. A drawing arrangement is disposed at a fixed position along the guide surface for allowing the carrier to be drawn away from the parts. The apparatus also includes a rotatably driven winding device around which the carrier is wound for pulling the carrier by way of the drawing arrangement to effect movement of the parts array within the guide passage as the parts array is guided along the guide surface and for causing the carrier to be separated from the parts as the parts move past the drawing arrangement before being discharged from the guide member.

According to another aspect of the present invention a parts array includes a plurality of resin molded parts, and a carrier to which each of the plurality of molded parts is attached so that the molded parts are arranged in a row on the carrier. The molded parts are attached to the carrier in such a way that the molded parts are separable from the carrier when the carrier is pulled away from the molded parts.

In accordance with a still further aspect of the present invention, a process for forming a parts array involves providing a carrier and attaching a plurality of resin molded parts to the carrier so that the parts are disposed in a row on the carrier. The parts are attached to the carrier so that when the carrier is pulled away from the parts the carrier is separated from the parts.

BRIEF DESCRIPTION OF THE DRAWING FIGURES

Further details and features associated with the present invention will become more apparent from the detailed description set forth below considered in conjunction with the accompanying drawing figures in which like elements are designated by like reference numerals and wherein.

DETAILED DESCRIPTION OF THE INVENTION

Figure 1:
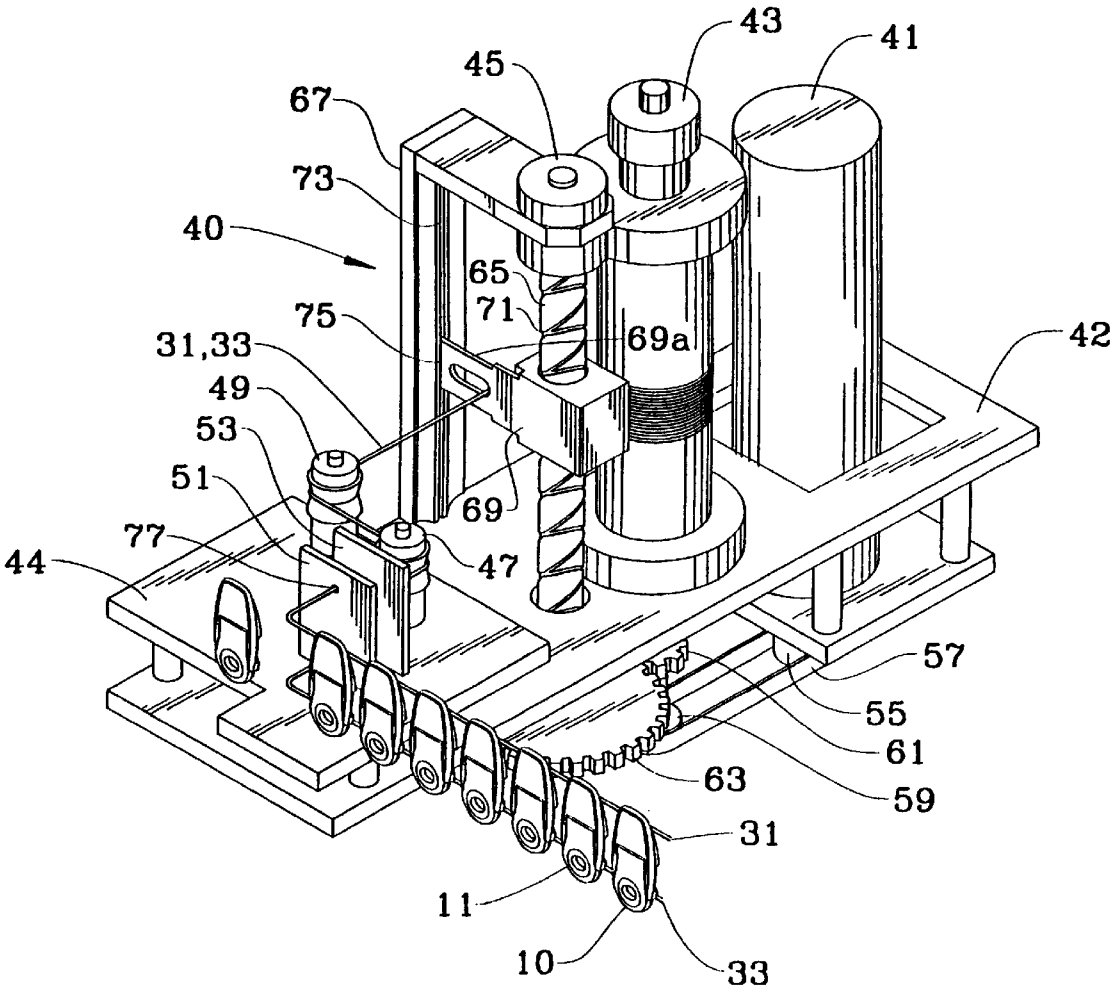
FIG. 1 is a top perspective view of a parts supplying apparatus and the parts array fed by the apparatus in accordance with the present invention.

With reference initially to FIG. 1, the parts supplying apparatus according to the present invention is designed to feed a parts array 10 in the form of a plurality of pouring spouts or pouring attachments 11. The pouring attachments are attached to a pair of wires 31 and 33 that are disposed generally parallel to one another. The pouring attachments 11 are molded articles and are attached to the wires 31, 33 in a row to form an elongated strip or parts array of pouring attachments 11. As can be sen in FIGS. 1 and 2, the pouring attachments 11 are disposed in the parts array 10 in substantially the same vertical orientation with respect to one another.

Figure 4:
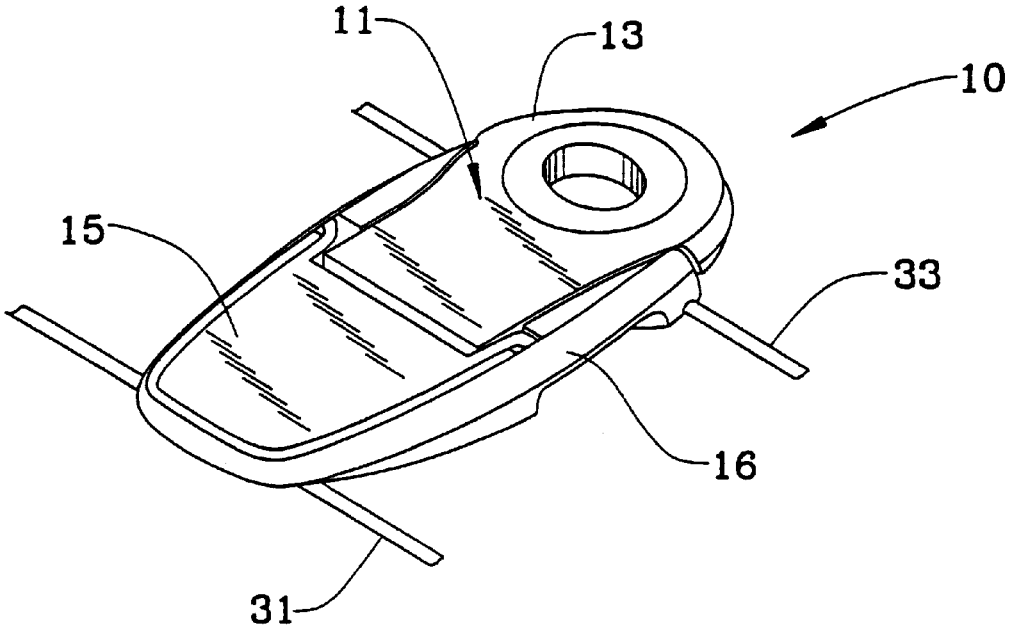
FIG. 4 is a perspective view of a pouring spout or pouring attachment attached to a pair of wires and forming a portion of the parts array in accordance with the present invention.

As seen with reference to FIG. 4, the pouring attachments 11 each include a base 16, an opening portion 15 that is adapted to effect opening of the container to which the attachment is secured, and a lifting part 13 that causes the opening part 15 to perform the opening operation through lifting action. The underside of each of the pouring attachments 11 is attached to the two parallel wires 31 and 33. The wires 31 and 33 are preferably integrally attached and formed with the resin molded pouring attachments 11 when the attachments 11 are molded by placing the wires 31, 33 into the molding die. The wires 31, 33, which can be made of plastic or metal such as steel, constitute a carrier for carrying the pouring attachments 11 and forming the pouring attachment array 10.

The wires 31, 33 are attached in the vicinity of the exterior underside surface of the pouring attachments 11 so that the wires 31, 33 can be removed from the pouring attachments 11 by pulling the wires away from the pouring attachments. The wires 31, 33 attached to the pouring attachments are spaced apart and preferably positioned adjacent opposite ends of the pouring attachments as shown in FIG. 4.

Figure 5:
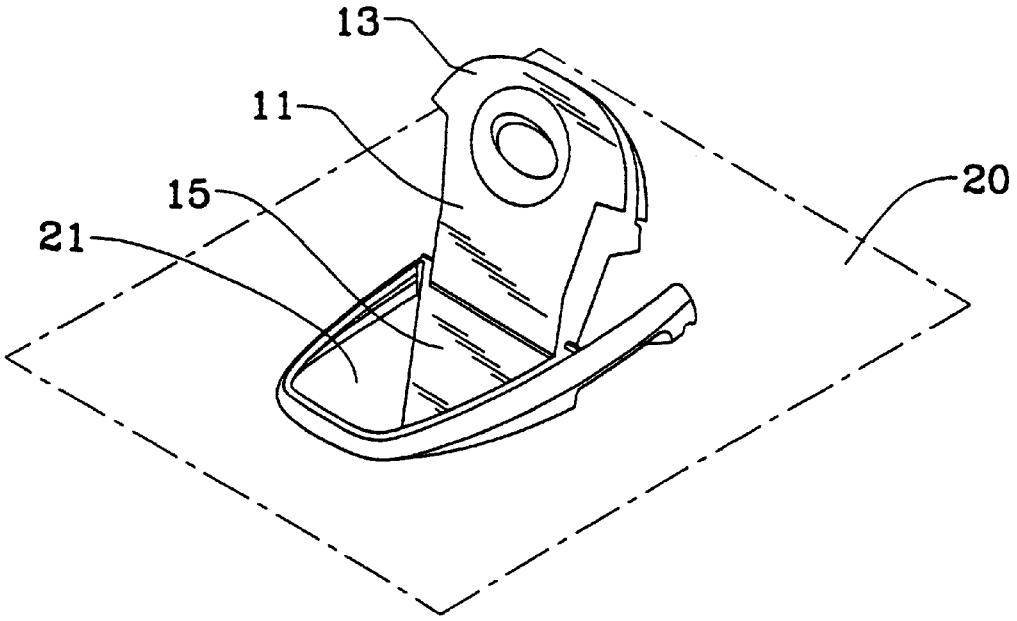
FIG. 5 is a perspective view of a portion of a container to which is attached the pouring spout or pouring attachment.
Figure 8:
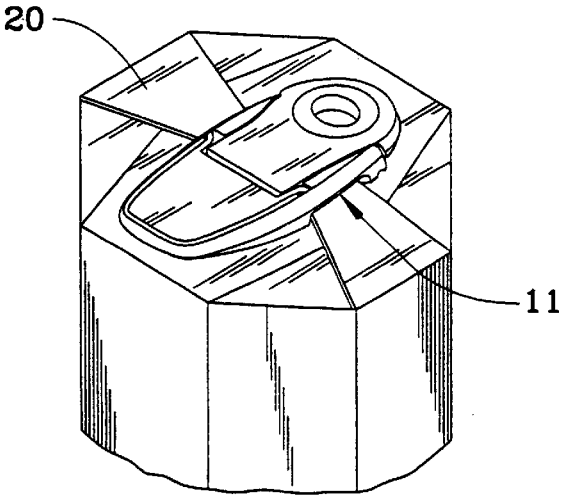
FIG. 8 is a perspective view of a top portion of a container to which is secured the pouring spout.

FIG. 5 illustrates the pouring attachment 11 separated from the wires 31, 33 and attached to the top of a container 20 formed from paper, plastic or the like. FIG. 8 also illustrates the pouring spout 11 attached to the top of a container. The pouring attachment can be secured to the container 20 by an automatic setting apparatus which is not specifically shown. More specifically, the pouring attachment 11 is attached to a sealing sheet (not specifically shown in the drawing figures) that has been previously adhered to the container 20 to close or seal the container opening 21 formed in the top of the container 20. The opening 21 in the container 20 is then opened by pulling up on the lifting part 13 of the pouring attachment 11 as shown in FIG. 5. This causes the opening part 15 to pivot down into the container opening 21, thus breaking the sealing sheet extending over the container opening 21.

Turning once again to FIG. 1, the parts supplying apparatus includes a winder arrangement 40 that is comprised of a motor 41, a winding drum 43, a winding position adjuster 45, two spaced apart guide rollers 47, 49, and two spaced apart guide plates 51, 53. The motor 41, the winding drum 43, the winding position adjuster 45, the pair of guide rollers 47, 49, and the pair of guide plates 51, 53 are all generally vertically oriented and disposed substantially parallel to one another. The motor 41, the winding drum 43 and the winding position adjuster 45 extend through respective openings in a first plate member 42 while the pair of guide rollers 47, 49 and the pair of guide plates 51, 53 are disposed on a second plate member 44 that is spaced above the first plate member 42.

The motor 41 possesses a rotary axle 55 that is coupled to the rotary axle 59 of the winding drum 43 via a horizontally disposed belt 57. The winding position adjuster 45 includes a rotary body or shaft 65 whose end is provided with a gear 63. The end of the rotary axle 59 is also outfitted with a gear 61. The gear 61 on the rotary axle 59 and the gear on the rotary body 65 engage one another. In this way, rotary movement of the motor 41 is transferred to the winding drum 43 and to the rotary body 65 of the winding position adjuster 45.

In addition to the rotary body 65, the winding position adjuster 45 is comprised of a generally vertically oriented support member 67 which supports and permits free rotation of the rotary body 65 and a vertically movable arm member 69 that is movable along the length of the rotary body 65. The support member 67 is provided with a groove 73 extending along the surface of the support member 67 that faces the rotary body 65.

The outer peripheral surface of the rotary body 65 is provided with spiral grooves 71 that are engaged by a pin (not specifically shown) which is located in a through hole in the movable arm member 69. The arm member 69 includes a generally horizontally extending projecting portion **69*a* having a free end that engages the vertical groove 73 of the support member 67 in such a way that the projecting portion 69*a* is guided over a vertical movement path. The projecting portion 69*a* is also formed with a generally horizontally elongated hole 75 through which is adapted to pass the pair of wires 31, 33**.

Figure 3:
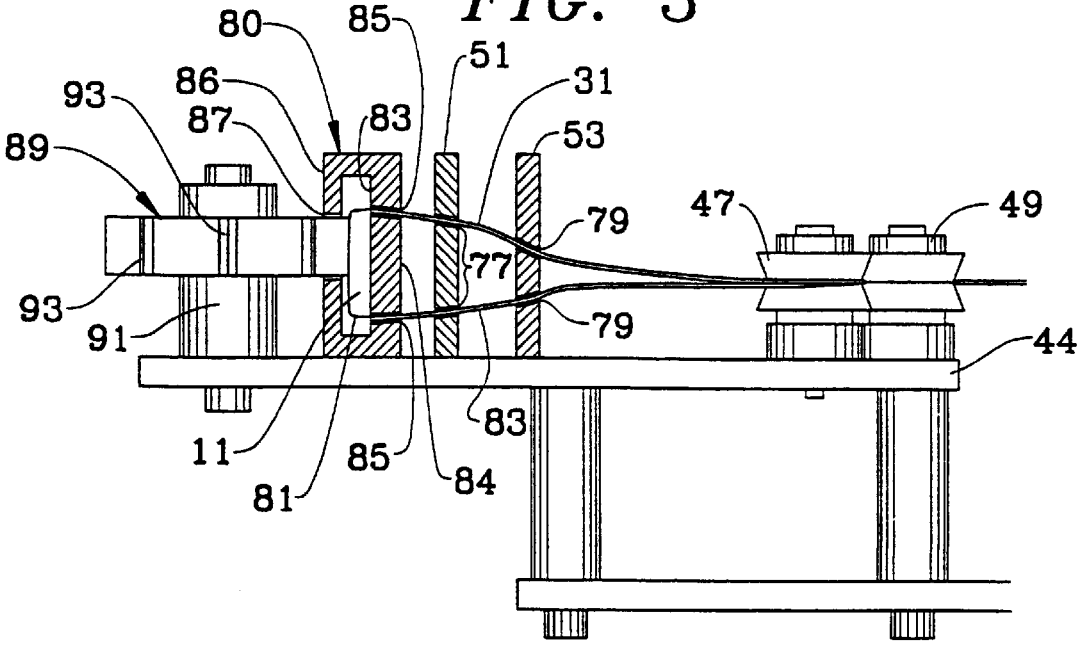
FIG. 3 is a side view of the portion of the parts supplying apparatus illustrated in FIG. 2.

As shown in FIG. 3, the first guide plate 51 is formed with two small holes 77, 77 and the second guide plate 53 is similarly formed with two small holes 79, 79. The holes 77, 77, 79, 79 are adapted to permit the passage of the pair of wires 31, 33 with the wires 31, 33 initially passing through the first guide plate 51 and subsequently through the second guide plate 53 located downstream of the first guide plate 51 with respect to the direction of travel of the wires 31, 33. The distance between the pair of holes 79, 79 in the second guide plate 53 is smaller than that between the pair of holes 77, 77 in the first guide plate 51, thereby causing the wires 31, 33 to approach one another as they pass from the first guide plate 51 to the second guide plate 53.

Figure 2:
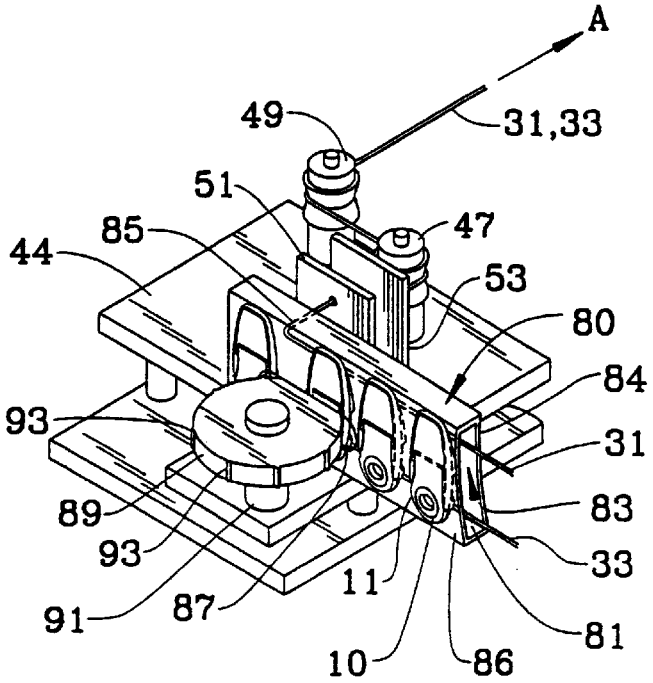
FIG. 2 is a top perspective view of a portion of the parts supplying apparatus shown in FIG. 1 illustrating the parts array fed by the apparatus.

As shown in FIG. 2, the apparatus further includes an array guide member 80 for guiding the array 10 of interconnected pouring attachments 11. The guide member 80 is an elongated, slender box-shaped element provided with a guide hole or guide passage 81 that extends along the length of the guide member 80. The guide hole 81 is sized to accommodate therein the pouring attachment array 10.

As can be seen from FIG. 3, the guide member 85 is provided with a pair of outlet holes 85 that communicate with the guide hole 81. The outlet holes 85 extend through the guide member side wall 84 that faces towards the first guide plate 51. The inside surface of the guide member side wall through which the outlet openings extend constitutes the guide surface 83 for the guide member 80.

As shown in FIGS. 2 and 3, the two outlet holes 85, 85 serve as a drawing arrangement through which are drawn the two wires 31, 33 from the pouring attachment array 10 passing through the guide hole 81 in the guide member 80. Furthermore, on the side wall 86 of the guide member 80 opposite the side wall 84 in which are located the outlet holes 85, 85 is provided with a generally horizontally elongated hole 87. This elongated hole 87 is adapted to receive a portion of the outer periphery of a rotary array advancing body 89 that is positioned adjacent the guide member 80.

The pouring attachments 11 on the array 10 are introduced into the longitudinally extending hole 87 and are pushed against the guide surface 83 of the guide member 80 by the rotary body 89 that is adapted to freely rotate about an axle 91. The rotational axis of the rotary body 89 is generally vertically oriented and the rotary body 89 lies in a plane that is generally perpendicularly oriented to the plane of movement of the array 10. The outer peripheral surface of the rotary body 89 is provided with projections 93 that are spaced apart from one another by a pitch that is approximately the same as the spacing between adjacent pouring attachments 11 on the array 10.

The wires 31, 33 that are separated from the pouring attachments 11 and fed through the outlet holes 85, 85 in the guide member 80 are fed to the winder 40 by way of the pair of guide rollers 47, 49 that are positioned downstream of the first guide plate 51 and the second guide plate 53 with respect to the direction of advancement of the array 10. The two guide rollers 47, 49 are mounted for free rotation on the second plate member 44. The rotational axes of the guide rollers 47, 49 are substantially parallel to one another and to the rotational axis of the array advancing rotary body 89.

The following is an explanation of the operation of the parts supply apparatus. When the motor 41 is rotatably driven, the winding drum 43 starts to rotate via the belt connection 57. At the same time, the rotary body 65 rotates through the interengaging gears 61, 63. The rotation of the rotary body 65 causes the arm member 69 to move axially up and down along the length of the rotary body 65 through the engagement between the pin (not specifically shown) on the arm member 69 and the spiral grooves 71 on the rotary body 65.

Due to the rotation of the winding drum 43, the wires 31, 33 are pulled through the holes 85 in the guide member 80 in the direction indicated by arrow A in FIG. 2. This causes the pouring attachment array 10 to moves through the guide passage 81 of the guide member 80. At the same time, the portion of the peripheral surface of the rotary body protruding through the opening 87 of the guide member 80 and into the guide passage 81 presses the array 10 into contacting engagement with the guide surface 83 of the guide member 80.

The foregoing operation also effects separation of the wires 31, 33 from the pouring attachments 11. With the rotary body 89 pushing the pouring attachment array 10 against the guide surface 83 of the guide member, the wires 31, 33 attached to the pouring attachments 11 peel away from the attachments 11 and are drawn out through the outlet holes 85, 85 on the guide surface 83. The separation of the wires 31, 33 from the pouring attachments can proceed rather easily because the array 10 is pushed against the guide surface 83 by the rotary body 89.

Once separated from the wires 31, 33, the pouring attachments 11 are discharged from the guide member 80 to the outside and are fed one by one to an automatic setting apparatus (not specifically shown) by a feeding device (not specifically shown) such as a chute or a manipulator arm. All of the separated pouring attachments 11 face in the same direction or are oriented in the same manner, and there is no possibility that any of them will be turned upside down. For this reason, it is possible to accurately attach the pouring attachments 11 to the proper place on a container such as shown in FIG. 5.

As the two wires 31, 33 are drawn out from the outlet holes 85, 85 and are passed through the small holes 77, 77, 79, 79 provided in the two guide plates 51, 53, the wires 31, 33 converge together as shown in FIG. 3 by virtue of the smaller spacing between the holes 79, 79 in the second guide plate 53. The wires 31, 33 are then conveyed over the guide rollers 47, 49 and are directed to the winding position adjuster 45 where the converged wires 31, 33 pass through the opening 75 in the projecting portion **69*a* of the mounting arm 69. The wires 31, 33 are then finally wound around the winding drum 43 as shown in FIG. 1. The mounting arm 69** which is moving vertically along the winding drum to produce generally even wound layers of wires.

The parts array 10 according to the present invention can be delivered to the parts supply apparatus as shown in FIG. 1 in a sterile condition since the pouring attachments 11 and the wires 31, 33 are simultaneously molded as one unit and due to the array 10 being in a sealed box. Moreover, only the guide member 80 and the rotary body 89 contact the parts array 10, and so it is only necessary to sterile these two elements. Thus, it is possible to easily keep the pouring attachments 11 in a hygienic or sterile condition without great difficulty.

Figure 6:
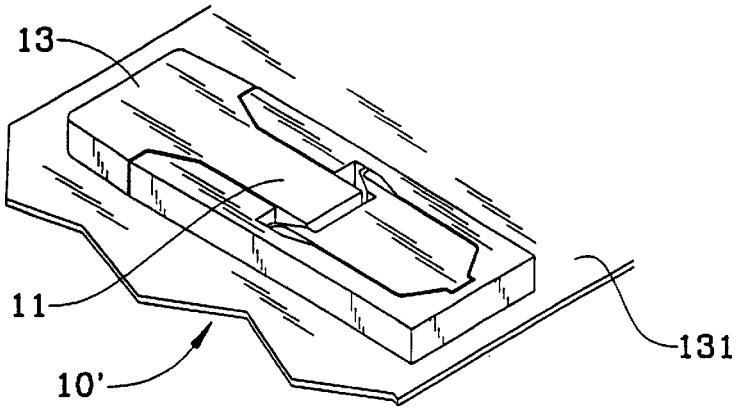
FIG. 6 is a perspective view of a portion of a parts array in which the pouring spout is mounted on a tape.

FIG. 6 illustrates an alternative embodiment of the pouring attachment or parts array 10'. The pouring attachment 11 is of the same general type as that described above, but in this alternative, the carrier on which the attachments 11 are disposed is in the form of a tape 131. The tape 131 preferably possesses a width sufficiently wide that the entire attachment is positioned on the tape 131. The tape 131 is rather thin so that the thickness of the tape is much less than the width of the tape 131.

The pouring attachments 11 are attached or secured to one surface of the tape 131 preferably by intermittently injecting thermoplastic resin at spaced apart locations on the tape 131 corresponding to the locations of the attachments 131. For example, the portion of the carrier (e.g., tape 131) corresponding to the location of the pouring attachment is placed on a flat wall of a first molding die. The portion of the carrier is then placed between the wall of the first molding die and a second molding die which is pushing from above the surface of the carrier. Thereafter, thermoplastic resin is injected onto the carrier to mold or form an attachment. After the injection step, the second mold is removed from the attachment that has been molded on the carrier, and the carrier is shifted with the integrally molded attachment by the necessary spacing between attachments so that the next pouring attachment can be molded. This process is advantageous as it represents a relatively efficient manner of making an aseptic parts array.

Figure 7:
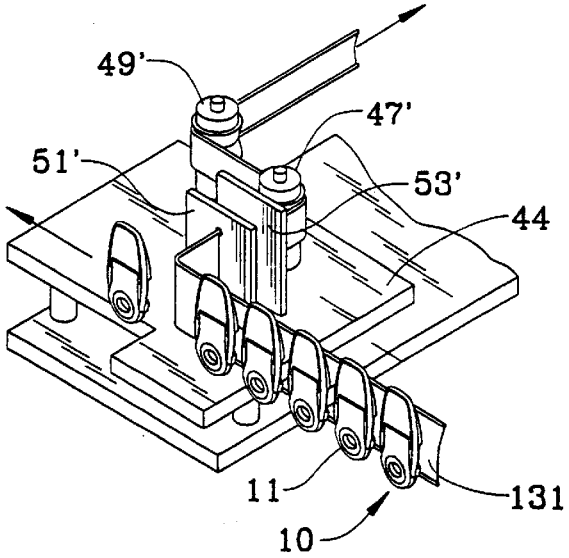
FIG. 7 is a top perspective view similar to FIG. 2 illustrating a portion of the parts supplying apparatus in which the spouts are disposed on a tape to produce the parts array.

FIG. 7 is a perspective view of a portion of the parts supplying apparatus used in conjunction with the parts array 10' shown in FIG. 6. As can be seen, the apparatus is quite similar to the apparatus described above, except that several parts of the apparatus are modified to accommodate the tape carrier shown in FIG. 6 rather than the plural wire carrier shown in FIG. 4. In particular, the first and second guide plates 51', 53' are each provided with an opening that is elongated in the vertical direction to accommodate the shape of the tape 131. It is also envisioned that the guide rollers 47', 49' need not be provided with a groove for receiving the tape as in the case of the embodiment of the apparatus shown in FIG. 3. Rather, the guide rollers 47', 49' can possess a cylindrical outer surface as generally shown in FIG. 7. Finally, although not specifically shown in FIG. 6, the elongated slot 75 in the projecting portion 69*a* of the mounting arm 69 (see FIG. 1 should preferably be oriented in the vertical direction to once again accommodate the configuration of the tape 131. The operation of the embodiment of the apparatus depicted in FIG. 7 is the same as that described above.

The present invention provides a parts supplying apparatus and parts array possessing a variety of advantages and desirable attributes. For example, a reduction in the size and cost associated with the parts supply apparatus can be rather easily achieved. Also, the design of the apparatus is well suited to ensuring minimal contact with the parts array so it is possible to maintain the sterility of the parts. Further, the parts supply apparatus of the present invention helps ensure accurate orientation of the parts removed from the parts array.

It is understood that variations with respect to the above described embodiments may be employed. For example, the present invention is applicable to resin molded parts other than the pouring spout or pouring attachment used in conjunction with containers. Also, in the above described embodiment, the guide hole 81 is provided in the guide member 80 and the guide surface 83 is provided to one surface of the guide hole. In the context of the present invention, as long as the guide surface 83 is present, the guide hole 81 is not necessary. The structure need only be such that at least one surface of the parts array is in contact with a guide surface that guides the movement of the parts array and a drawing means is provided at a fixed position on the guide surface to draw the wires for a parts array in a direction away from the pouring attachments or other molded parts. Additionally, it is envisioned that the carrier illustrated in FIG. 4 is not limited to two wires, but can be in the form of three or more wires.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

We claim:

1. A pouring spout array, comprising a plurality of resin-molded pouring spouts for attachment to containers and a carrier to which each of the plurality of resin-molded pouring spouts is attached so that the pouring spouts are arranged in a row on the carrier, the pouring spouts each including a base portion adapted to be attached to a container and an opening portion movable with respect to the base portion to produce an opening in the container, said plurality of pouring spouts being attached to the carrier in such a way that the pouring spouts are separable from the carrier when the carrier is pulled away from the pouring spouts.

2. A pouring spout array according to claim 1, wherein the carrier is a tape and the resin-molded pouring spouts are attached to the tape by injection molding the pouring spouts on the carrier.

3. A pouring spout array according to claim 2, wherein the pouring spouts are arranged on the tape in a single row and the pouring spouts are all oriented in the same manner on the tape.

4. A pouring spout array according to claim 1, wherein the carrier includes a pair of spaced apart wires.

5. A pouring spout array according to claim 4, wherein the wires are integrally molded into each of the resin-molded pouring spouts.

6. A pouring spout array according to claim 1, wherein each pouring spout includes a lifting part for effecting movement of the opening portion to produce an opening in the container.

7. A process for forming a pouring spout array, comprising providing a carrier, attaching to the carrier a plurality of resin-molded pouring spouts that each include a base portion adapted to be attached to a container and an opening portion movable with respect to the base portion to produce an opening in the container, the pouring spouts being attached to the carrier so that the pouring spouts are disposed in a row on the carrier, the pouring spouts being attached to the carrier so that when the carrier is pulled away from the pouring spouts the carrier is separated from the pouring spouts.

8. A process according to claim 7, wherein said step of attaching the pouring spouts to the carrier includes intermittently injecting thermoplastic resin on the carrier to form the pouring spouts on the carrier.

9. A process according to claim 8, wherein said step of attaching the pouring spouts to the carrier includes placing a pair of wires in a mold and integrally molding the wires with the pouring spouts.

* * * * *